United States Patent [19]

Tordenmalm et al.

[11] Patent Number: 4,896,582

[45] Date of Patent: Jan. 30, 1990

[54] METHOD FOR REDUCING THE PISTON SPEED, ESPECIALLY IN THE PISTON AND CYLINDER ASSEMBLIES OF AN EXCAVATING MACHINE, AND DEVICE FOR CARRYING OUT THE METHOD

[75] Inventors: Lars Ö. Tordenmalm, Södra Sandby; Ingvar Bruhn, Höör, both of Sweden

[73] Assignee: Akermans Verkstad AB, Eslöv, Sweden

[21] Appl. No.: 216,542

[22] PCT Filed: Jan. 8, 1986

[86] PCT No.: PCT/SE86/00003

§ 371 Date: Sep. 8, 1988

§ 102(e) Date: Sep. 8, 1988

[87] PCT Pub. No.: WO87/04220

PCT Pub. Date: Jul. 16, 1987

[30] Foreign Application Priority Data

Jan. 7, 1985 [SE] Sweden ..... 8500048

[51] Int. Cl.[4] ..... F15B 13/16

[52] U.S. Cl. ..... 91/361; 91/393; 91/461; 414/699

[58] Field of Search ..... 91/459, 361, 362, 363 R, 91/364, 393, 368, 461; 414/699, 701

[56] References Cited

U.S. PATENT DOCUMENTS

| | | | |
|---|---|---|---|
| 3,098,382 | 7/1963 | Hoffman et al. | 91/363 R |
| 4,037,519 | 7/1977 | Miller et al. | 414/699 X |
| 4,136,600 | 1/1979 | Heiser | 91/363 R |
| 4,202,247 | 5/1980 | Hunkar et al. | 91/461 X |
| 4,574,687 | 3/1986 | Kauss et al. | 91/461 |
| 4,598,626 | 7/1986 | Walters et al. | 91/461 X |
| 4,733,600 | 3/1988 | Masano | 91/461 X |

FOREIGN PATENT DOCUMENTS

| | | |
|---|---|---|
| 0022105 | 1/1981 | European Pat. Off. . |
| 3110676 | 10/1982 | Fed. Rep. of Germany . |
| 1382057 | 11/1972 | United Kingdom . |
| 1560242 | 1/1980 | United Kingdom . |

*Primary Examiner*—Edward K. Look

*Attorney, Agent, or Firm*—Birch, Stewart, Kolasch & Birch

[57] ABSTRACT

The invention relates to a method and a device for reducing the piston speed in a piston and cylinder assembly (1), as the piston approaches the end position. The piston end position is sensed, and a signal is generated for starting the end position dampening. Dampening is effected in two steps. In the first step (14), a time delay is provided and in the next step (15), the actual braking (retardation) of the piston is effected.

The invention also comprises an electronic braking device comprising a dampening activation unit (13) which is connected to sensors (6), a braking delay unit (14) connected to the unit (13) and also to the actual control lever (5) at issue and a reference signal source, as well as a braking unit (15) connected to the delay unit (14) and adapted, upon activation, to provide a signal (U) to a setting system (3) for controlling the supply of pressure fluid to the piston and cylinder assembly (1).

11 Claims, 3 Drawing Sheets

Sa=LEVER SIGNAL AT ISSUE $|Sa|_{max}$=CONSTANT REFERENCE LEVER SIGNAL (CORRESPONDS TO MAX.LEVER SIGNAL)

t=TIME $t_0$=MOMENT WHEN SIGNAL IS OBTAINED FOR START OF END POSITION DAMPENING t1=MOMENT FOR START OF PISTON RETARDATION

METHOD FOR REDUCING THE PISTON SPEED, ESPECIALLY IN THE PISTON AND CYLINDER ASSEMBLIES OF AN EXCAVATING MACHINE, AND DEVICE FOR CARRYING OUT THE METHOD

The present invention relates to a method and device for reducing the piston speed as the piston approaches end positions in a piston and cylinder assembly in an excavating machine, for example.

DESCRIPTION OF THE BACKGROUND ART

An excavating machine usually comprises a number of pressure medium-operated cylinders (pneumatic/hydraulic cylinders). Thus, an excavating machine has hydraulic cylinders for, inter alia, the boom and shovel stem movements of the excavating unit. If the cylinder end positions are not dampened, jolts occur which subject the cylinders, the boom and the shovel stem to sizable loads by which the working life of these parts is reduced materially, simultaneously as the actual excavating movement is adversely affected. In some cases, however, these jolts are put to good use, for example for emptying the shovel of an excavating machine.

Many different devices are known in the art for reducing the rate of motion of a piston. The most common device is a transducer which mechanically senses the position of the piston in the end region and activates a means for throttling the supply of pressure medium. However, devices of this type are difficult to mount and are not fully reliable. It is also known to design the piston and/or the cylinder ends in a specific manner, for instance by mounting on the piston a pin which projects into the mouth of the pressure medium drainage channel to throttle the flow. Also solutions of this type are open to objections. It is obvious that a reduced piston movement is unnecessary when the piston moves away from the adjacent cylinder end.

Prior art patented devices are described and shown in the two French patent Nos. 2,125,982 and 2,178,549 and in the European patent No. 0,022,105. According to these patents, the position of the piston is recorded continuously, i.e. also during the entire retardation period of the piston. According to French patent No. 2,125,982, the retardation of the piston movement at the end position is always initiated in the same cylinder position, irrespective of the piston speed, so that the speed reduction starts at an uncalled-for early moment at low speeds. In addition, the electrical circuit employed causes the retardation to be the same in both end positions.

According to French patent No. 2,178,549, on the other hand, the start of retardation is postponed at lower piston speeds. However, the actual speed reduction occurs regardless of how far the piston has travelled from the end position. Also in this case, the retardation is the same in both end positions. Different retardations for the two end positions would be preferable because the pressure-actuated piston area frequently is larger at one piston end than at the other so that different speeds occur. The above-mentioned shortcomings are eliminated by means of the device according to European patent No. 0,022,105 in which, however, a continuous recording of the piston position is a prerequisite. Besides, this device cannot be used in an excavating machine where end position jolts are an object to be desired.

SUMMARY OF THE INVENTION

It is the object of the present invention to eliminate the above-mentioned shortcomings, and this object is achieved by means of a method comprising the steps of generating a position signal when the piston passes a predetermined position adjacent the ends of the cylinder; supplying the position signal to a signal processing system; supplying the position signal, a reference signal and a control signal to a delay unit; comparing the control level signal to the reference signal; generating a comparison signal after a delay time period based on the comparing; applying the comparison signal and the control level signal to a braking unit; processing the comparison signal and control level signal by the braking unit to generate an output signal; applying the output signal and a signal indicating direction of piston travel to a setting system; and controlling supply of piston medium to the piston and cylinder by the setting system to thereby reduce the speed of the piston.

The invention also relates to a device of the type for reducing piston speed and, for specifically reducing the piston speed in, an excavating machine as the piston approaches the end positions. This device has the characteristic features of a signal transducer adapted to sense when the piston passes a predetermined position adjacent ends of a cylinder, control means for generating a positive or negative control signal for respectively extending and retracting the piston cylinder assembly, a pressure medium system, a setting system operatively connected to the pressure medium system for controlling the pressure medium system and supply of pressure medium to the piston and cylinder assembly, a delay unit and a braking unit. The delay unit receives a position signal generated when the piston passes the predetermined position and receives a reference signal and a control lever signal. The display unit is activated by the position signal to compare the control level signal with the reference signal and generate a comparison signal after a delay time period. The braking unit will then receive and process the comparison signal and the control level signal to generate an output signal. This output signal together with a direction signal indicating the direction of piston travel will be applied to the setting system to control the supply of pressure medium to the piston of the piston and cylinder assembly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will be described in more detail below with reference being made to the accompanying drawings which are given by way of illustration only, and thus are not limitative of the present invention, and wherein.

DETAILED DESCRIPTION OF THE PREFERRED EMBODIMENTS

Figure 1:
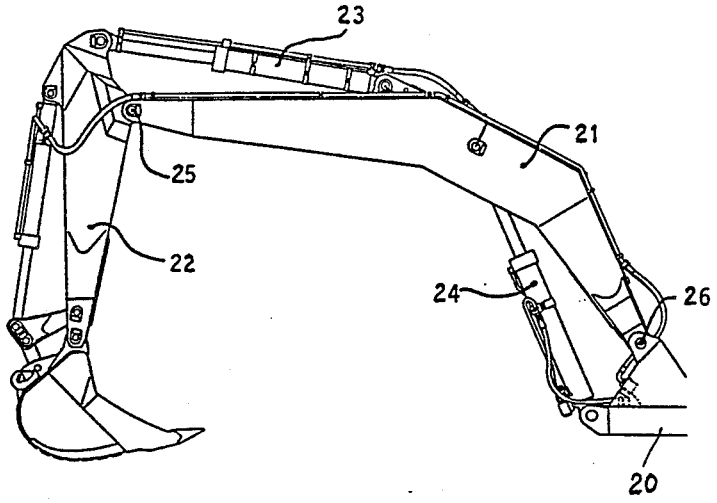
FIG. 1 is a lateral view of an excavating unit.

FIG. 1 shows the boom 21 and the shovel stem 22 with its associated cylinders 23 and 24 in an excavating unit for an excavating machine 20. In order to indicate when the pistons of the respective cylinders 23, 24 are at a predetermined distance from the respective outer end positions, for example with the piston rod extended, a transducer is provided to provide a signal to start an end position dampening. The transducer is mounted in such a manner that a signal is obtained independently of the piston speed when the piston is at a predetermined distance from the cylinder end position. In this manner also at a maximum piston speed, smooth braking without any undesired upsetting jolt is obtained.

One known way of indirectly obtaining the piston positions in the cylinders 23, 24 is to mount angle transducers at the pivot points 25 and 26 between the stem 22 and the boom 21 and between the boom 21 and the excavating machine. The angle signal is subsequently converted into a piston position signal.

Figure 2:
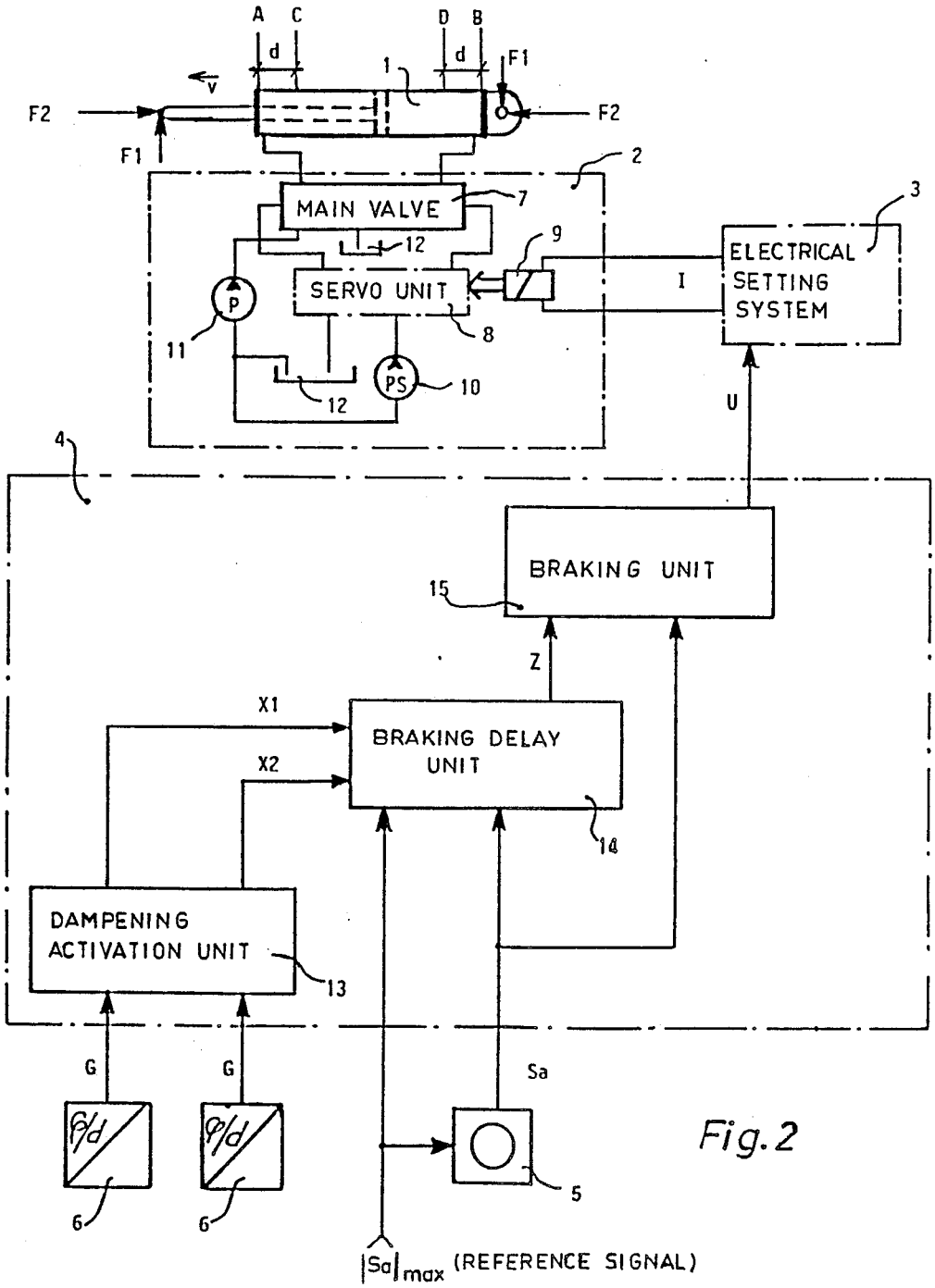
FIG. 2 illustrates a device for end position dampening.

FIG. 2 illustrates the manner in which the dampening device of a single working cylinder has been integrated with the conventional pressure medium system of the excavating machine.

For setting the piston rod position in a working cylinder 1, for example one of the cylinders 23, 24 in FIG. 1, under the action of a load corresponding to the forces F1 and F2, the working cylinder 1 is connected to a pressure medium system 2 which is controlled via an electromagnet 9 by means of an electric setting system 3. System 3 actuated by a signal from the control lever 5 of the operator, transducers 6, and an end position dampening system 4. The pressure medium system 2 comprises a main valve 7 for setting the working cylinder 1, a servo unit 8 controlled by the electromagnet 9, a pump 10 for the servo pressure medium, a pump 11 for the operating pressure medium, and a pressure medium tank 12. The end position dampening system 4 which is electrically connected to the electric setting system 3, comprises a dampening activation unit 13, a braking delay unit 14, and a braking unit 15.

The essential components of the electric end position dampening system 4 will now be described. The system 4 actuates the working cylinder 1 via the electric setting system 3 for the pressure medium servo unit 8 by means of the electromagnet 9.

The piston rod end position of the working cylinder 1 is controlled by the machine operator by means of a lever signal Sa provided by the control lever 5. With the control lever in neutral position, a zero signal is obtained. By means of the control lever, a positive lever signal Sa for outward piston rod movement and a negative lever signal Sa for inward piston rod movement, for example, is provided.

By suitable positioning of the transducer 6, a transducer signal G is obtained indirectly which corresponds to the position of the piston, by measuring the angle in a suitable pivot point on the excavating unit of the machine. The signal G is subsequently converted in the dampening activation unit 13 into a signal corresponding to the cylinder piston position. Alternatively, an end position signal is obtained directly by means of a transducer which is mounted on or in the cylinder. A constant reference lever signal $|Sa|$ max is applied to the braking delay unit 14 and the control lever 5. When the piston is not in any of the end positions A-C and B-D, respectively, shown in FIG. 2, the dampening activation unit 13 provides the output signals $X1=0$ and $X2=0$.

Figure 3:
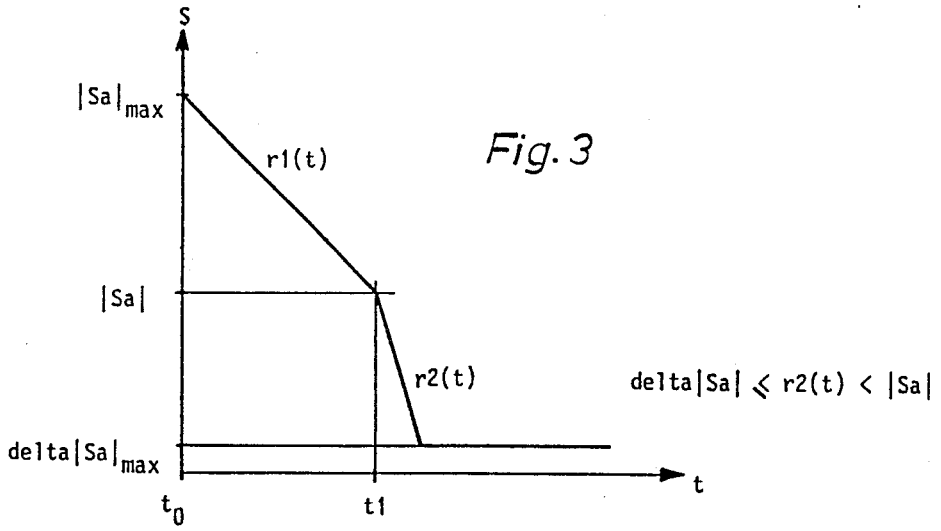
FIG. 3 illustrates a method of providing an electric signal suitable for the end position dampening.

When the piston is moving towards any of the end positions A and B, and a signal G from the transducer 6 is obtained, optionally after conversion, corresponding to a piston position at a given distance d from the piston end position, the dampening activation unit 13 provides a remaining output signal $X1=1$ ($X2=0$) at the piston position A-C, alternatively $X2=1$ ($X1=0$) at the piston position B-D for initiating the end position dampening. The braking delay unit 14 now causes a delay of the piston retardation start by starting a ramp function r1(t) linearly decreasing in time. The starting value of said ramp function is equal to a constant maximal reference lever signal $|Sa|$ max as indicated in FIG. 3. When $r1(t) < |Sa\}$, the braking delay unit 14 supplies the signal $Z=1$ to the braking unit 15 for starting a ramp signal r2(t) linearly decreasing in time (see FIG. 3), the starting value of said ramp signal being equal to the lever signal $|Sa|$ at issue (as long as $Z=0$, however, $U=|Sa|$ is set). At $Z=1$, the braking unit 15 also compares the two signals $|Sa|$ and r2(t) and provides an output signal $U=\min(|Sa|,rt(t))$ to the electric setting system 3. Since the signal U here is an absolute value and does indicate if the control lever 5 is actuated for outward or inward movement of the cylinder piston rod, the electric setting system 3 also obtains an input signal which represents the sign "+" or "−" of the lever signal Sa at issue. However, it is also possible to impart to the signal U a "+" or "−" sign, in which case the connection, shown in FIG. 2, between the control lever 5 and the setting system 3 is excluded.

If, during the above-mentioned braking operation, the control lever 5 is actuated such that the lever signal Sa at issue becomes 0 or changes sign, the output signal Z of the braking delay unit 14 is given the value 0, and the output signal U of the braking unit 15 will be equal to $|Sa|$ and the piston movement is again directly actuated by the lever signal Sa. In order to produce end position jolts, the braking delay unit 14 can be actuated to provide a pre-delay for $\Delta t$ seconds ($\Delta t$ being about 1 second) prior to start of the ramp function r1(t) as soon as the lever signal Sa at issue $\neq 0$ (i.e. the lever is moved from neutral position). For adaptation to the specific conditions that apply to the respective end position, for example different piston speeds because of different piston end areas, the ramp signals r1(t) and r2(t) may have different values as indicated by the curve slope in FIG. 3.

In addition, the ramp signal r2(t) has a given minimum value delta $|Sa|_{max}$ to ensure that the piston always reaches the end position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Method for reducing speed of a piston in a piston and cylinder assembly as the piston approaches end positions of the cylinder, said method comprising the steps of:

generating a position signal when the piston passes a predetermined position adjacent ends of the cylinder;

supplying the position signal to a signal processing system;

supplying the position signal, a reference signal and a control lever signal to a delay unit;

comparing the control lever signal to the reference signal with the delay unit;

generating a comparison signal after a delay time period based on the comparing;

applying the comparison signal and the control lever signal to a braking unit;

processing the comparison signal and control lever signal by the braking unit to generate an output signal;

applying the output signal and a signal indicating direction of piston movement to a setting system; and controlling supply of pressure medium to the piston and cylinder by the setting system to thereby reduce the speed of the piston.

2. The method as claimed in claim 1, further comprising the step of generating a ramp function decreasing linearly in time by the delay unit, a starting value of the ramp function corresponding to the reference signal and a minimum value equalling the absolute value of the applied control signal at issue.

3. The method as claimed in claim 1, further comprising the step of providing the braking unit with a ramp function decreasing linearly in time, the ramp function having a starting value equalling the absolute value of the control signal at issue and having a predetermined minimum value.

4. The method as claimed in claim 1, wherein the step of generating the piston position signal starts braking of boom and stem cylinders of an excavating machine occurs indirectly by angle measurement of rotation of the boom about its horizontal suspension axis and an angle between a common pivot point of the boom and the stem, said angles being converted into the corresponding piston positions.

5. The method as claimed in claim 1, wherein the step of generating the piston position signal is used for braking boom and stem cylinders of an excavating machine and occurs indirectly by discrete detection of two separate positions of rotation of the boom about its horizontal suspension axis, and two separate angles between a common pivot point of the boom and the stem, said angles corresponding to the piston position.

6. Device for reducing speed of a piston in a piston and cylinder assembly as the piston approaches end positions of the cylinder, the device comprising:

a signal transducer adapted to sense when the piston passes a predetermined position adjacent ends of the cylinder;

control means for generating a positive or negative control signal for respectively extending and retracting the piston and cylinder assembly;

a pressure medium system;

a setting system operatively connected to the pressure medium system for controlling the pressure medium system and supply of pressure medium to the piston and cylinder assembly;

a delay unit for receiving a position signal generated when the piston passes the predetermined position and receiving a reference signal and a control lever signal, said delay unit being activated by the position signal to compare the control lever signal with the reference signal and to generate a comparison signal after a delay time period; and a braking unit for receiving and processing the comparison signal and the control lever signal to generate an output signal, said output signal together with a direction signal indicating a direction of piston travel being applied to the setting system to control the supply of pressure medium to the piston and cylinder assembly.

7. The device as claimed in claim 6, further comprising a dampening activation unit to which said position signals are applied which provides an output signal when the piston is within the end position.

8. The device as claimed in claim 7, wherein said delay unit has function design generating means which, upon application of a signal from said activation unit determines the delay time period by starting a ramp function which decreases linearly in time, and has a starting value equal to the fixed reference signal and a minimum value equal to the absolute value of the applied control signal at issue.

9. The device as claimed in claim 6, wherein said braking unit has means for providing, upon application of an input signal, the output signal as a function decreasing in time.

10. The device as recited in claim 9, wherein the function of the means for providing of the braking unit is a ramp function.

11. The device as recited in any one of claims 7, 8, 9, 6 or 10 wherein said delay unit further comprises means for providing a constant delay at the start of the delaying function.

* * * * *

UNITED STATES PATENT AND TRADEMARK OFFICE

CERTIFICATE OF CORRECTION

PATENT NO. : 4,896,582

DATED : January 30, 1990

INVENTOR(S) : Lars Östen TORDENMALM and Ingvar BRUHN

It is certified that error appears in the above-identified patent and that said Letters Patent is hereby corrected as shown below:

ON THE TITLE PAGE:

In the category of [57] ABSTRACT

Column 1, line 14, change "An excavating" to -- A working -- line 16, change "excavating machine" to -- excavator -- line 17, change "shovel" to -- bucket dipper arm -- line 18, delete "stem"

line 18, change "excavating unit. If the cylinder" to -- digging equipment. If the piston end positions of the cylinder --

UNITED STATES PATENT AND TRADEMARK OFFICE

CERTIFICATE OF CORRECTION

PATENT NO. : 4,896,582

DATED : January 30, 1990

INVENTOR(S) : Lars Östen TORDENMALM and Ingvar BRUHN

It is certified that error appears in the above-identified patent and that said Letters Patent is hereby corrected as shown below:

Column 1, line 19, delete "end positions"

line 19, change "jolts" to -- shocks -- line 20, change "shovel stem" to -- bucket dipper arm -- line 24, change "jolts" to -- shocks -- line 28, change "transducer" to -- sensor -- line 43, change "recorded" to -- detected -- line 47, change "cylinder" to -- piston -- line 67, change "jolts" to -- shocks --

UNITED STATES PATENT AND TRADEMARK OFFICE

CERTIFICATE OF CORRECTION

PATENT NO. : 4,896,582

DATED : January 30, 1990

INVENTOR(S) : Lars Österen TORDENMALM and Ingvar BRUHN

It is certified that error appears in the above-identified patent and that said Letters Patent is hereby corrected as shown below:

Column 2, line 23, change "an excavating" to -- a working -- line 64, change "an excavating unit" to -- a digging equipment --

Column 3, line 14, change "shovel stem" to -- bucket dipper arm -- line 5, change "an excavating" to -- a digging -- line 6, change "unit" to -- equipment -- line 11, change "transducer" to -- sensor -- line 16, change "jolt" to -- shock -- line 18, delete "trans-"

UNITED STATES PATENT AND TRADEMARK OFFICE

CERTIFICATE OF CORRECTION

PATENT NO. : 4,896,582

DATED : January 30, 1990

INVENTOR(S) : Lars Östen TORDENMALM and Ingvar BRUHN

It is certified that error appears in the above-identified patent and that said Letters Patent is hereby corrected as shown below:

Column 3, line 19, change "ducers" to -- sensors -- line 19, change "stem 22" to -- dipper arm 22 -- line 33, before "actuated" insert -- is -- line 34, change "transducers" to -- sensors -- line 57, change "transducer" to -- sensor -- line 57, delete "trans-"

line 58, change "ducer" to -- sensor -- line 60, change "excavating unit" to -- digging equipment -- line 64, delete "trans-"

line 65, change "ducer" to -- sensor --

UNITED STATES PATENT AND TRADEMARK OFFICE

CERTIFICATE OF CORRECTION

PATENT NO. : 4,896,582

DATED : January 30, 1990

INVENTOR(S) : Lars Östen TORDENMALM and Ingvar BRUHN

It is certified that error appears in the above-identified patent and that said Letters Patent is hereby corrected as shown below:

Column 3, line 66, change "|Sa| max" to -- |Sa|max -- line 67, change "lever" to -- means --

Column 4, line 5, change "transducer" to -- sensor -- line 20, before "lever" insert -- actual -- line 21, delete "at issue"

line 24, change "(|Sa|,rt(t)) to -- (|Sa|,r2(t)) -- line 25, after "does" insert -- not -- line 29, change "lever signal Sa at" to

-- actual lever signal Sa. -- line 30, delete "issue"

UNITED STATES PATENT AND TRADEMARK OFFICE

CERTIFICATE OF CORRECTION

PATENT NO. : 4,896,582

DATED : January 30, 1990

INVENTOR(S) : Lars Österen TORDENMALM and Ingvar BRUHN

It is certified that error appears in the above-identified patent and that said Letters Patent is hereby corrected as shown below:

Column 4, line 31, change "sign" to -- value -- line 41, change "jolts" to -- shocks -- line 42, change "Λt" to -- Δt -- line 42, before "being" insert -- normally -- line 44, before "lever" insert -- actual -- line 44, delete "at issue"

Column 5, in the claims:

Claim 4, lines 3 and 7, change "stem" to -- dipper arm --

Claim 5, lines 3 and 7, change "stem" to -- dipper arm --

Signed and Sealed this

Sixteenth Day of June, 1992

*Attest:*

DOUGLAS B. COMER

*Attesting Officer*

*Acting Commissioner of Patents and Trademarks*